US008074989B1

(12) United States Patent
Bassett

(10) Patent No.: US 8,074,989 B1
(45) Date of Patent: Dec. 13, 2011

(54) PUZZLE FOR THE PHYSICALLY OR VISUALLY IMPAIRED

(76) Inventor: Donald F. Bassett, St. Cloud, FL (US)

( * ) Notice: Subject to any disclaimer, the term of this patent is extended or adjusted under 35 U.S.C. 154(b) by 0 days.

(21) Appl. No.: 12/821,278

(22) Filed: Jun. 23, 2010

(51) Int. Cl.
*A63F 9/10* (2006.01)

(52) U.S. Cl. ..... 273/157 R

(58) Field of Classification Search ..... 273/157 R, 273/156, 153 R
See application file for complete search history.

(56) References Cited

U.S. PATENT DOCUMENTS

| | | | | | |
|---|---|---|---|---|---|
| 941,680 | A * | 11/1909 | Houghton | 273/157 R |
| 2,170,909 | A * | 8/1939 | Moren | 273/157 R |
| 2,506,189 | A * | 5/1950 | Attridge | 273/157 R |
| 2,711,595 | A * | 6/1955 | Sharp | 273/157 R |
| 3,010,723 | A * | 11/1961 | Moss | 273/157 R |
| 3,137,967 | A * | 6/1964 | Flieth | 273/157 R |
| 3,151,867 | A * | 10/1964 | Miller | 273/157 R |
| 3,433,485 | A | 3/1969 | Renn et al. | |
| 3,746,343 | A | 7/1973 | Shaprio | |
| 3,903,617 | A * | 9/1975 | Evans | 434/171 |
| 3,909,003 | A * | 9/1975 | Rabinovich | 273/157 R |
| 4,044,476 | A * | 8/1977 | Marsh | 273/157 R |
| 4,243,224 | A * | 1/1981 | Spector | 273/157 R |
| 5,787,622 | A * | 8/1998 | Green et al. | 273/157 R |
| 5,895,044 | A * | 4/1999 | Bahramian | 273/157 R |
| 6,267,374 | B1 | 7/2001 | Bourbeau | |
| 6,655,685 | B2 | 12/2003 | Tsai | |
| 6,663,732 | B1 | 12/2003 | Link | |
| 6,672,588 | B1 * | 1/2004 | Kielar et al. | 273/157 R |
| 7,347,421 | B2 | 3/2008 | Ibach | |
| 7,490,831 | B2 * | 2/2009 | Simmons | 273/157 R |
| 7,510,187 | B2 | 3/2009 | Haag | |
| 2005/0167913 | A1 * | 8/2005 | Mucci et al. | 273/157 R |
| 2005/0194738 | A1 * | 9/2005 | Simmons | 273/157 R |
| 2007/0257431 | A1 * | 11/2007 | Chuang | 273/153 R |
| 2008/0136099 | A1 * | 6/2008 | Frost | 273/157 R |
| 2009/0026701 | A1 * | 1/2009 | Khatai | 273/157 R |

* cited by examiner

*Primary Examiner* — Steven Wong
(74) *Attorney, Agent, or Firm* — Timothy H. Van Dyke; Beusse, Wolter, Sanks, Mora & Maire, P.A.

(57) ABSTRACT

A puzzle, including a closed perimeter including a plurality of segments, wherein each segment includes on a segment upper surface raised indicia different than the raised indicia present on any other segment, and a plurality of uniquely shaped game pieces. The game pieces include: segment intersection pieces each including on an intersection piece upper surface the raised indicia of two segments against which the segment intersection piece rests; edge pieces each including on an edge piece upper surface the raised indicia of a segment against which each edge piece rests; and inner pieces including an inner piece indicator to indicate an upright orientation. The uniquely shaped game pieces assemble together in only one way to form an assembled puzzle.

32 Claims, 5 Drawing Sheets

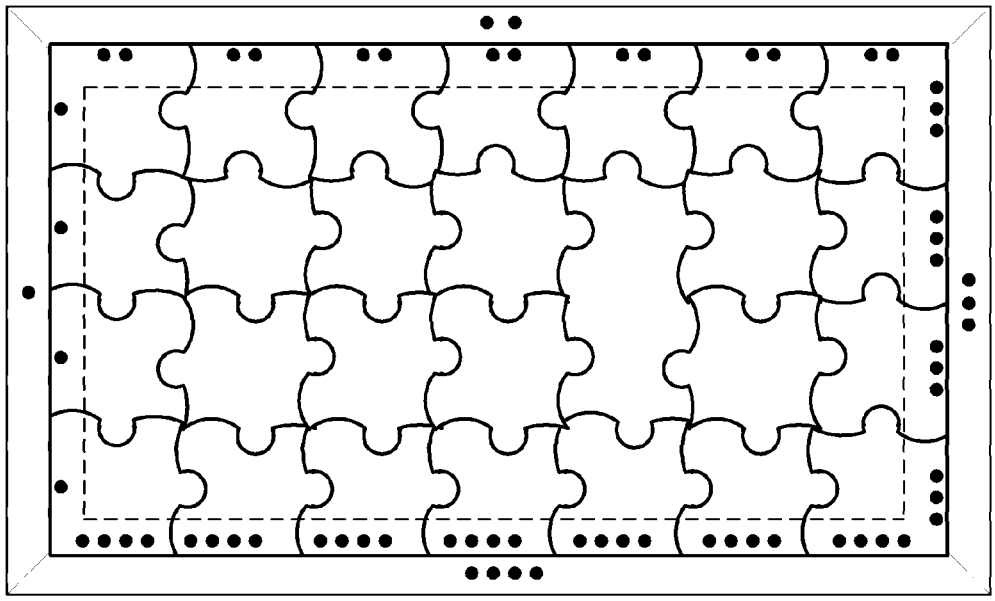
FIG. 10
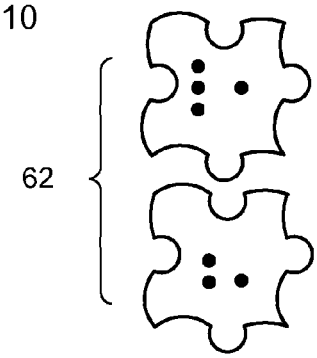

PUZZLE FOR THE PHYSICALLY OR VISUALLY IMPAIRED

FIELD OF THE INVENTION

This invention relates to puzzles, and in particular to jigsaw puzzles well suited for those with reduced visual acuity and/or reduced manual dexterity.

BACKGROUND

Jigsaw puzzles are commonly composed of small, thin pieces each having a portion of a picture on it. Assembly of the pieces is usually accomplished first by visually matching the images and shapes of adjacent pieces, and second by physically assembling the interlocking pieces. Consequently, the person assembling the puzzle must rely on a certain level of visual acuity and manual dexterity that many people possess. However, for a person with limited or no vision, assembly can prove exceedingly difficult because the critical visual cues are not ascertainable. For a person of limited dexterity, commonly sized puzzle pieces can also prove to be exceedingly difficult to place, even when the placement is known. Also, since many puzzle pieces can at least somewhat engage adjacent pieces even when improperly placed, removing improperly placed puzzle pieces can provide further challenge. Consequently there is room in the art for improvements to puzzles that will make them accessible to a wider range of people.

SUMMARY

An embodiment is directed toward a puzzle, including a closed perimeter including a plurality of segments, wherein each segment includes on a segment upper surface raised indicia different than the raised indicia present on any other segment, and a plurality of uniquely shaped game pieces. The game pieces include: segment intersection pieces each including on an intersection piece upper surface the raised indicia of two segments against which the segment intersection piece rests; edge pieces each including on an edge piece upper surface the raised indicia of a segment against which each edge piece rests; and inner pieces including an inner piece indicator to indicate an upright orientation. The uniquely shaped game pieces assemble together in only one way to form an assembled puzzle.

Another embodiment is directed toward a puzzle, including: a closed perimeter including a plurality of segments, wherein each segment includes on a segment upper surface raised indicia unique among the plurality of segments; a plurality of uniquely shaped game pieces, wherein game pieces adjacent a segment include on an game piece upper surface the raised indicia of the adjacent segment, wherein remaining game pieces include a indicator to indicate an upright orientation, and wherein game piece sides gradually recede from adjacent game pieces from a contact region to a game piece lower surface. The uniquely shaped game pieces assemble together in only one way to form an assembled puzzle.

Another embodiment is directed toward a puzzle, including: a perimeter including a plurality of segments, wherein each segment including on a segment upper surface raised indicia unique among the plurality of segments; and a plurality of uniquely shaped game pieces. Pieces adjacent a segment include on an game piece upper surface the raised indicia of the adjacent segment, and remaining pieces include a indicator to indicate an upright orientation. The uniquely shaped game pieces assemble together in only one way to form an assembled puzzle, and no less than three and no more than ten game pieces are adjacent any segment, and no game piece surface area is less than three square inches.

Yet another embodiment is directed toward a puzzle, including: a closed perimeter including a plurality of segments, wherein each segment includes on a segment upper surface raised indicia different than the raised indicia present on any other segment, and wherein each segment includes a raised portion on an inner side; and a plurality of uniquely shaped game pieces. Game pieces are: segment intersection pieces each including on an intersection piece upper surface the raised indicia of two segments against which the segment intersection piece rests; edge pieces each including on an edge piece upper surface the raised indicia of a segment against which each edge piece rests, wherein sides of game pieces abutting segments are configured to receive the respective segment raised portion; and inner pieces including an inner piece indicator to indicate an upright orientation. Game piece sides gradually recede from adjacent game pieces a contact region to a game piece lower surface. No less than three and no more than ten game pieces are adjacent any segment, no game piece surface area is less than three square inches, and the uniquely shaped game pieces assemble together in only one way to form an assembled puzzle.

BRIEF DESCRIPTION OF THE DRAWINGS

The invention is explained in the following description in view of the drawings that show:

FIG. 10 shows an alternative embodiment of a puzzle with pieces removed wherein two or more of the internal pieces include tactilely discernible information.

DETAILED DESCRIPTION

Conventional puzzles appeal to a wide range of people, including those with a vision or dexterity limitation that renders conventional puzzles physically challenging beyond the mental challenge the puzzle creator intended, and likely beyond what the puzzler anticipated. Such persons (puzzlers) include the partially or completely blind, those who have sustained injury to or decreased function of fingers, a hand, an arm, or the brain etc. To eliminate this unintended physical frustration, the inventor has designed an innovative puzzle that will enable puzzlers with visual and/or manual dexterity limitations to enjoy the mental challenge of assembling a puzzle without the unwanted physical challenge. The puzzle taught herein can be assembled using only physical cues, and the puzzle pieces are configured such that they can be assembled and disassembled with significantly less motor skill than required in conventional puzzles.

The puzzle pieces are grouped into three categories. A puzzler can ascertain the category of the piece and an approximate location for the piece in the assembled puzzle without having to rely on the conventional visual cues present on the puzzle piece and the image of the assembled puzzle. This is possible because each piece contains a physical cue indicating the category of the piece and an approximate location for the piece in the assembled puzzle.

Once the approximate location of the piece is ascertained, the puzzler can ascertain the physical shape of the piece itself to determine its final position within the assembled puzzle. This is possible because the puzzle pieces are much larger than conventional puzzle pieces. Also, the puzzle and puzzle piece dimensions are maintained such that a level of difficulty desired by the puzzle maker is maintained, while not creating the unwanted physical difficulty. As a result, those with limited dexterity are still able to determine the physical shape.

Once the final position is chosen, the puzzle pieces are easily placed using simple gross motor movements because the pieces are shaped to permit them to fall into place without exact positioning. Finally, should a piece be improperly placed, it may readily be removed also using simple gross motor movements because of its basic shape, and also because it may be furnished with a notch the puzzler can use to catch or hook the piece, making it possible to remove the piece without disturbing the other pieces.

Figure 1:
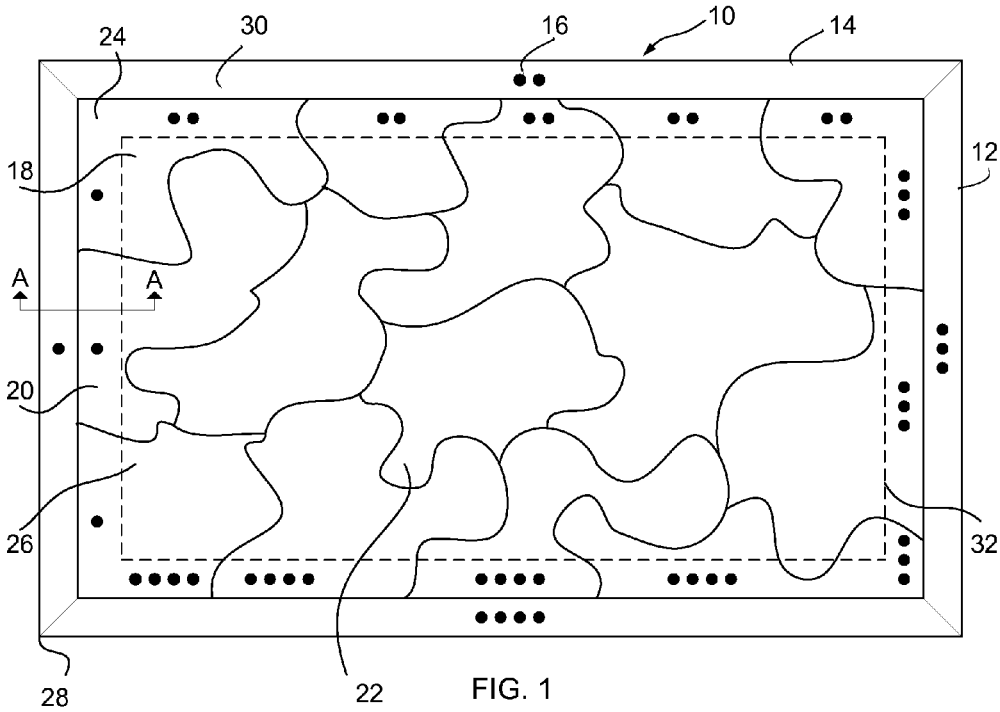
FIG. 1 shows an assembled puzzle.

Turning to the drawings, FIG. 1 shows an assembled puzzle 10 comprising a perimeter 12 filled with assembled game pieces 18, 20, 22, each being unique. The perimeter may be closed such that it entirely encloses the puzzle, and comprises at least one segment 14, and on a segment upper surface 30 of each segment is raised indicia 16 unique among segments to that segment 14. The perimeter 12 of the puzzle 10 shown comprises four segments joined at segment intersections 30. The perimeter 12 may be a parallelogram or any shape desired by the puzzle maker. As shown in FIG. 1, the pieces do not interlock with the segments.

Puzzle solving commonly involves first placing the pieces whose position can most readily be determined, and progressing to those whose position can least readily be determined. This usually entails placing the corner pieces first, then edge pieces, and finally working through the remaining inner pieces. Consequently, game pieces 18, 20, 22 of the instant puzzle 10 are categorized as segment intersection pieces 18, edge pieces 20, and inner pieces 22.

Segment intersection pieces 18 are to be disposed within the perimeter 12 at a location where two segments 14 intersect, and may rest against both of the intersecting segments. Segment intersection pieces 18 may be considered corner pieces when the segments 14 intersect to form a corner. The raised indicia 16 present on each segment 14 against which the segment intersection piece 18 rests will also be present on the segment intersection piece upper surface 24, and preferable more proximate the respective segment 14 so the puzzler will know how to orient the edge piece 20 against the respective segments 14. As a result, when a puzzler handles a segment intersection piece 18 the puzzler will feel two sets of raised indicia 16 and then the puzzler will know the piece is a segment intersection piece 18. The puzzler will be able to ascertain where the segment intersection piece 18 goes by matching the raised indicia 16 on the segment intersection piece 18 with the segments 14 of the perimeter 12 against which it should be placed. The presence of the raised indicia 16 thus precludes the need for the puzzler to see an image on the segment intersection piece 18 in order to properly place it. However, an image may be present on any or all game pieces 18, 20, 22 in addition to the indicia 16 if desired.

Edge pieces 20 are to be disposed within the perimeter 12 at locations other than where segment intersection pieces 18 are present, thereby filling in the entire perimeter 12 of the puzzle 10. The raised indicia 16 present on the segment 14 against which the edge piece 20 rests will also be present on the edge piece upper surface 26, and preferable proximate the segment 14 so the puzzler will know which part of the edge piece 20 goes against the respective segment 14.

Inner pieces 22 are to be disposed in the remaining unsolved area of the puzzle 10. Inner pieces may comprise an indicator (not shown here but discussed below) which will enable a puzzler to determine an upright orientation of the inner game piece 22. Once the puzzler has established proper orientation of the inner game piece 22 the puzzler can determine its proper location in the puzzle 10 by comparing the shape of the inner game piece 22 to the exposed shapes of the game pieces already assembled.

The game pieces 18, 20, 22 themselves must be large enough for one of limited manual dexterity to be able to manipulate. While no particular size is mandated, the inventor has found that game pieces with a surface area of approximately 0.02 square feet or more work well. This is not a firm lower limit, but is a guideline. Also, to limit complexity, the inventor has found that the total surface of the assembled game pieces should not exceed approximately 9 square feet. This is not a firm upper limit, but is a guideline. Another metric to control complexity is the number of pieces that may be adjacent any segment. While not firm limits, the inventor has found that having not less than three of any game piece against a single segment and having not more than 10 of any game piece against a single segment works well.

Figure 2:
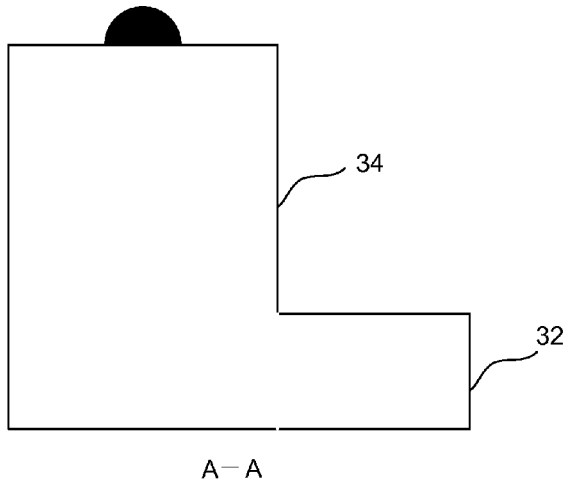
FIG. 2 shows cross section A-A of a perimeter segment from FIG. 1.

As can be seen in FIG. 2, segments 14 may also comprise a raised portion 32 on a segment inner side 34. This raised portion 32 may extend the entire perimeter 12 and may cooperate with all game pieces placed against the perimeter 12, such as segment intersection pieces 18 and edge pieces 20, to further indicate that the game pieces are to be placed against a segment 14. Through the use of the above described perimeter 12 and game pieces 18, 20, 22, a puzzler with reduced visual acuity and/or manual dexterity will be able to assemble a puzzle without unwanted physical frustrations normally associated with common puzzles.

Figure 3:
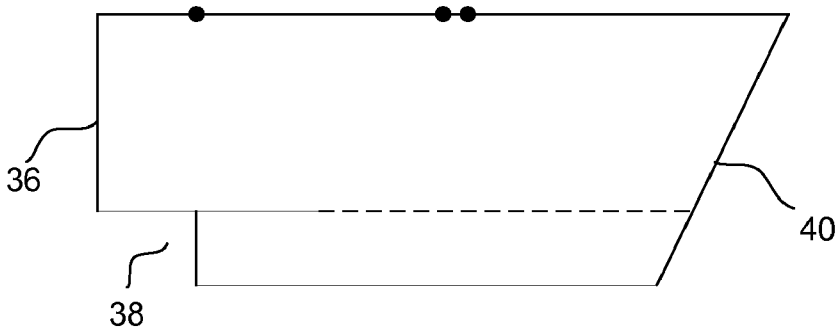
FIG. 3 shows a side view of the upper left corner piece of FIG. 1 with a sloped game piece side.

As can be seen in FIG. 3, which is a side view of the upper left segment intersection piece 18 of FIG. 1, the segment intersection piece 18 comprises an abutting side 36 that abuts a respective segment 14. Present on the abutting side 36 is a cooperating portion 38 that cooperates with the raised portion 32 of the adjacent segment 14 to aid the puzzler in placing the game pieces.

The act of placing puzzle pieces can be made easier by shaping the geometry of each puzzle piece so that fine motor skills are not required, but gross motor skills may suffice. Prior art puzzle pieces may be cut such that the sides of the piece are at ninety degrees to the top and bottom surfaces. As a result, in order to properly place the piece between assembled pieces the puzzler must position the piece exactly right in terms of location and angle. If the piece is off by only a minimal angle it cannot be pressed into place. Clearly at this point the desired mental challenge of figuring out the location of the piece would have been overcome, but for one of limited visual acuity and/or manual dexterity, the unwanted challenge of placing the piece remains, which may result in unnecessary frustration.

As can also be seen in FIG. 3, the game piece comprises a game piece side 40. Game piece sides 40 are sides of a game piece 18, 20, 22 that abut adjacent game pieces 18, 20, 22. The inventor angles the game piece side 40 of the game pieces such that the sides slope away, i.e. recede from adjacent game pieces 18, 20, 22. As a result, a game piece whose proper position in the puzzle 10 has been ascertained need not be placed perfectly, but can be roughly positioned and once positioned the piece will align itself and fall into place on its own. Consequently, the unwanted physical challenge of positioning the game piece has been reduced or eliminated.

Figure 4:
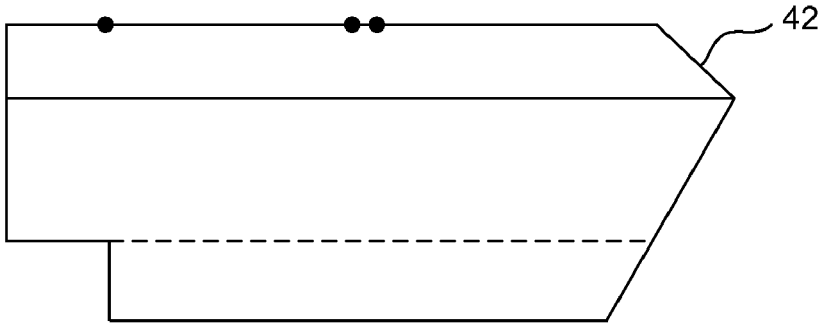
FIG. 4 show a side view of the upper left corner piece of FIG. 1 with a chamfer.
Figure 5:
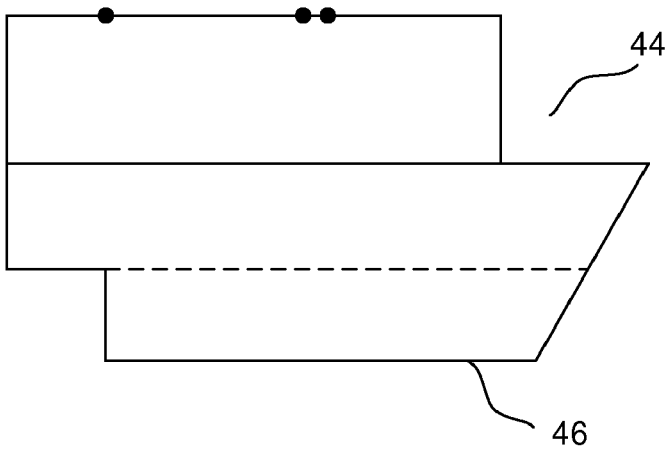
FIG. 5 show a side view of the upper left corner piece of FIG. 1 with a notch.

Improperly placed game pieces that have partially engaged adjacent game pieces can prove especially challenging to retrieve in conventional game pieces. However, the sloped game piece side 40 described above also permits a puzzler to readily remove an improperly placed game piece 18, 20, 22. With such a slope all a puzzler needs to do is press on the improperly placed game piece 18, 20, 22 near a game piece side and the game piece 18, 20, 22 will pivot about the game piece side bottom corner, raising the rest of the game piece 18, 20, 22 above the other assembled game pieces, making it accessible to the puzzler. The puzzler can then simple remove the game piece 18, 20, 22. Additionally, as can be seen in FIG. 4, a chamfer 42 can be added at a point or all along the game piece side 40 to facilitate the rotation of the game piece 18, 20, 22 in response to pressure from the puzzler. Alternately, as can be seen in FIG. 5, a notch 44 can be positioned at a point or all along the game piece side 40 which a puzzler can engage with a finger tip in order to lift the game piece 18, 20, 22 from adjacent pieces. Also shown in FIG. 5 is a thickness 46 of the game piece. No particular thickness 46 for the game piece is mandated, but the thickness 46 should be chosen to facilitate tactile recognition of features by those of limited or no visual acuity, and tactile recognition of features via manipulation by those of limited manual dexterity. The inventor has found that thicknesses about 0.25" and above, or more preferably 0.5" and above, serve these functions well.

Figure 6:
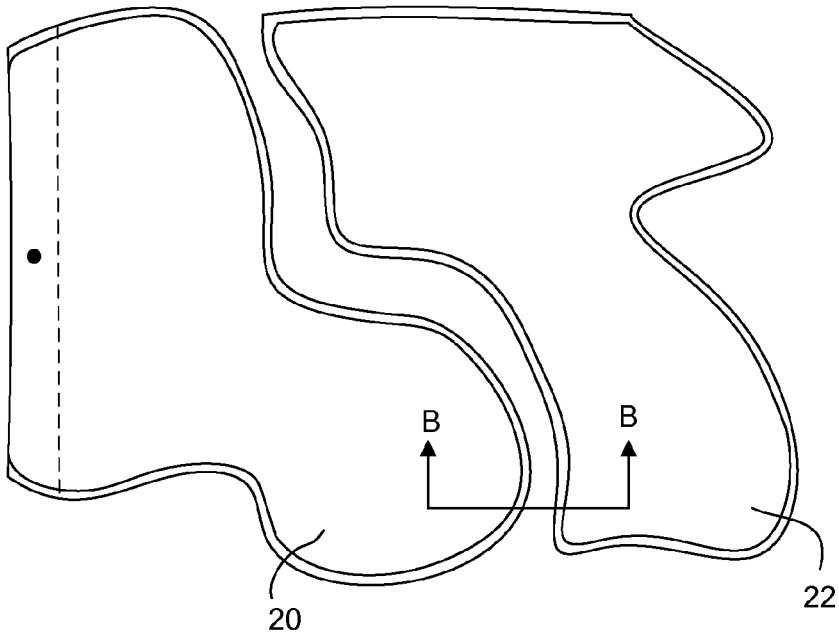
FIG. 6 shows an edge piece and inner piece from FIG. 1 assembled together.
Figure 7:
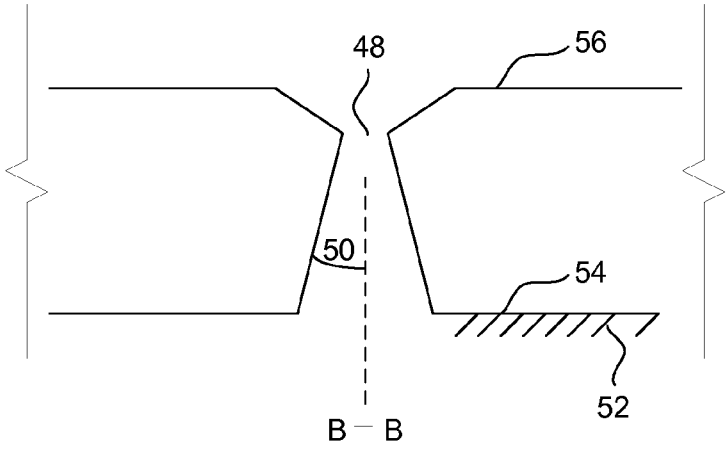
FIG. 7 shows cross section B-B of the adjacent game piece sides of the game pieces of FIG. 6.

FIG. 6 shows an edge piece 20 and an inner piece 22 properly placed together. FIG. 7 is a partial cross section from FIG. 6, showing a contact region 48 where adjacent game pieces 18, 20, 22 contact, and a game piece side slope 50 which is defined as the slope the game piece side 40 takes as compared to a line normal to a top or bottom surface of the game piece 18, 20, 22. No particular slope is mandated. It is only necessary that the slope facilitate placement and removal of game pieces 18, 20, 22. The inventor has found that slopes of up to 50 degrees serve these functions well. Also visible in FIG. 6 is inner piece indicator 52. As shown the inner piece indicator 52 is a feature on a inner piece lower surface 54, but the indicator can be on an inner piece upper surface 56, or anywhere on the inner game piece 22 so long as the puzzler can ascertain an upright orientation. The inner piece indicator 52 can be, for example, a textured surface, or other indicator from which a puzzler will intuitively be able to determine when a game piece is upright.

Figure 8:
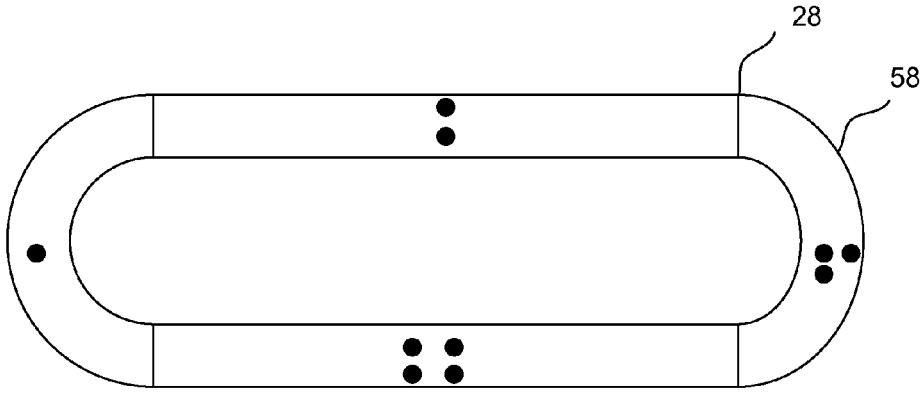
FIG. 8 shows an alternate embodiment of a perimeter with a non-linear segment.
Figure 9:
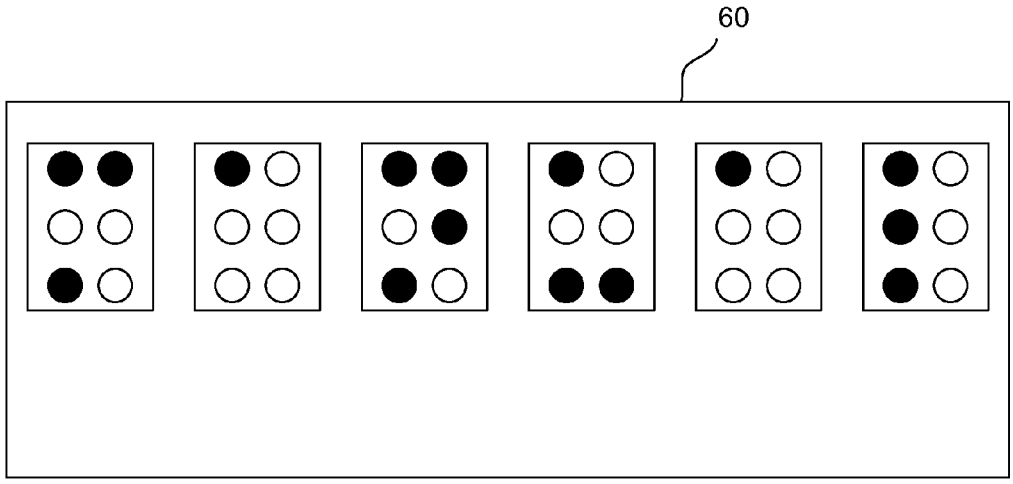
FIG. 9 shows an instruction manual in Braille.

In an embodiment shown in FIG. 8, the perimeter 12 may have at least one non linear segment 58. Any perimeter configuration is acceptable so long as the puzzler can identify segment intersections 28. FIG. 9 shows a manual 60 for the puzzle 10 which may be written in Braille and accompany the puzzle.

FIG. 10 shows an alternative puzzle design wherein groups of pieces have a duplicated design. This makes it more difficult for a visually impaired puzzler to solve where the pieces fit. This embodiment shows a close-up of a couple of pieces 62 that have been removed from the puzzle. Two or more of the pieces include on a top surface thereof tactilely discernible information that clues in the puzzler as to the placement of a given piece in relation to other parts of the overall puzzle. This may include but is not limited to information of color, design, information of what region of the puzzle the piece fits, etc.

It has been shown that the present inventor has devised a puzzle that anyone can use, including those with limited or no visual acuity and/or little or no manual dexterity. The inventive puzzle eliminates a puzzler's dependence on visual acuity and fine motor movements, thereby enabling the puzzler to focus on the mental challenge of finding the right positions for the puzzle pieces, and not be distracted by an unwanted physical challenge.

Any cited references are incorporated herein in their entirety to the extent not inconsistent with the teachings herein. While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A puzzle, comprising a closed frame comprising a plurality of segments, wherein each segment comprises on a segment upper surface at least one raised indicium, wherein the at least one raised indicium on each segment is different than the at least one raised indicium present on any other segment;

a plurality of uniquely shaped game pieces, comprising:

segment intersection pieces each comprising on an intersection piece upper surface the at least one raised indicium of two segments against which the segment intersection piece rests but does not interlock;

edge pieces each comprising on an edge piece upper surface the at least one raised indicium of a segment against which each edge piece rests but does not interlock; and inner pieces comprising an inner piece indicator to indicate an upright orientation, wherein the uniquely shaped game pieces assemble together in only one way to form an assembled puzzle.

2. The puzzle of claim 1, wherein the closed perimeter is a polygon.

3. The puzzle of claim 1, wherein the plurality of segments comprises a non-linear segment.

4. The puzzle of claim 1, wherein the at least one raised indicium comprises Braille.

5. The puzzle of claim 1, wherein each respective at least one raised indicium on the segment intersection piece is disposed proximate the segment with the same at least one raised indicium.

6. The puzzle of claim 1, wherein the inner piece indicator is a surface indicator.

7. The puzzle of claim 6, wherein the inner piece indicator is a textured inner piece upper or lower surface.

8. The puzzle of claim 1, wherein each segment comprises a raised portion on an inner side, and wherein abutting sides of edge pieces are configured to receive the raised portion.

9. The puzzle of claim 8, wherein the raised portion is common to all segments.

10. The puzzle of claim 1, wherein adjacent game pieces make contact at a contact region disposed on sides of each game piece, and wherein sides of game pieces slope away from adjacent game pieces from the contact region to a game piece lower surface.

11. The puzzle of claim 1, wherein a slope angle is below 50 degrees with respect to a line normal to a game piece lower surface.

12. The puzzle of claim 1, wherein at least one game piece comprises a notch where a game piece upper surface meets a side.

13. The puzzle of claim 12, wherein the notch extends the entire perimeter of the game piece upper surface.

14. The puzzle of claim 1, wherein at least two edge pieces rest against each segment.

15. The puzzle of claim 1, wherein the assembled puzzle comprises a total surface area not greater than 9 square feet, and each game piece comprises an individual surface area not less than 0.02 square feet.

16. The puzzle of claim 1, wherein each game piece comprises a thickness not less than 0.25 inches.

17. A kit comprising the puzzle of claim 1 and tactilely readable instructions.

18. A puzzle, comprising:

a closed frame comprising a plurality of segments, wherein each segment comprises on a segment upper surface raised category information comprising at least one raised indicium, wherein the raised category information of each segment is unique among the plurality of segments;

a plurality of uniquely shaped game pieces, wherein game pieces adjacent a segment do not interlock with the segment and comprise on an game piece upper surface the raised category information of the adjacent segment, wherein remaining game pieces comprise a indicator to indicate an upright orientation, and wherein game piece sides gradually recede from adjacent game pieces from a contact region to a game piece lower surface, wherein the uniquely shaped game pieces assemble together in only one way to form an assembled puzzle.

19. The puzzle of claim 18, wherein the plurality of uniquely shaped game pieces comprises segment intersection pieces each comprising on an intersection piece upper surface the raised category information of two segments against which the segment intersection piece rests but does not interlock.

20. The puzzle of claim 18, wherein the indicator is a game piece surface indicator.

21. The puzzle of claim 18, wherein each segment comprises a raised portion on an inner side, and wherein abutting sides of game pieces are configured to receive the raised portion.

22. The puzzle of claim 18, wherein game piece sides gradually recede from adjacent game pieces along a slope angle that is below 50 degrees with respect to a line normal to a game piece surface.

23. The puzzle of claim 18, wherein at least one game piece comprises a notch where a game piece upper surface meets a side.

24. A puzzle, comprising:

a frame comprising a plurality of segments, wherein each segment comprises on a segment upper surface raised category information comprising at least one raised indicium, wherein the raised category information of each segment is unique among the plurality of segments;

a plurality of uniquely shaped game pieces, wherein pieces abutting but not interlocking with a segment comprise on an game piece upper surface the raised category information of the adjacent segment, and wherein remaining pieces comprise a indicator to indicate an upright orientation, wherein the uniquely shaped game pieces assemble together in only one way to form an assembled puzzle, wherein no less than three and no more than ten game pieces are adjacent any segment, and no game piece surface area is less than three square inches.

25. The puzzle of claim 24, wherein the plurality of uniquely shaped game pieces comprises segment intersection pieces each comprising on an game piece upper surface the raised category information of two segments against which the segment intersection piece rests but does not interlock.

26. The puzzle of claim 24, wherein the indicator is a game piece surface indicator.

27. The puzzle of claim 24, wherein each segment comprises a raised portion on an inner side, and wherein abutting sides of game pieces are configured to receive the raised portion.

28. The puzzle of claim 24, wherein game piece sides gradually recede from adjacent game pieces from a contact region to a game piece lower surface.

29. The puzzle of claim 24, wherein at least one game piece comprises a notch where an game piece upper surface meets a side.

30. A puzzle, comprising:

a closed frame comprising a plurality of segments, wherein each segment comprises on a segment upper surface a raised indicium or indicia different than the raised indicium or indicia present on any other segment, and wherein each segment comprises a raised portion on an inner side;

a plurality of uniquely shaped game pieces, comprising:

segment intersection pieces each comprising on an intersection piece upper surface the raised indicium or indicia of two segments against which the segment intersection piece rests but does not interlock;

edge pieces each comprising on an edge piece upper surface the raised indicium or indicia of a segment against which each edge piece rests but does not interlock, wherein sides of game pieces abutting segments are configured to receive the respective segment raised portion; and inner pieces comprising an inner piece indicator to indicate an upright orientation, wherein game piece sides gradually recede from adjacent game pieces a contact region to a game piece lower surface, wherein no less than three and no more than ten game pieces are adjacent any segment, and no game piece surface area is less than three square inches, and wherein the uniquely shaped game pieces assemble together in only one way to form an assembled puzzle.

31. The puzzle of claim 30, wherein the inner piece indicator is an inner piece surface indicator.

32. The puzzle of claim 30, wherein at least one game piece comprises a notch where the intersection piece upper surface meets a side.

* * * * *